US006408589B1

(12) United States Patent
Bousquet

(10) Patent No.: US 6,408,589 B1
(45) Date of Patent: Jun. 25, 2002

(54) CLIP FOR ATTACHMENT TO FLANGES OF STRUCTURAL STEEL

(76) Inventor: Donavon G. Bousquet, 3300 A St., South Sioux City, NE (US) 68776

( * ) Notice: Subject to any disclaimer, the term of this patent is extended or adjusted under 35 U.S.C. 154(b) by 0 days.

(21) Appl. No.: 09/635,612

(22) Filed: Aug. 10, 2000

Related U.S. Application Data

(60) Provisional application No. 60/149,139, filed on Aug. 16, 1999.

(51) Int. Cl.[7] ..... E04C 3/30

(52) U.S. Cl. ..... 52/714; 52/712; 52/717.06; 24/295

(58) Field of Search ..... 52/289, 716.8, 52/717.03, 717.06, 506.05, 506.06, DIG. 8, 731.1, 732.1, 732.2, 698, 712; 248/228.7, 228.1, 228.3; 24/295

(56) References Cited

U.S. PATENT DOCUMENTS 3,748,815 A * 7/1973 Parker ..... 52/714
3,897,669 A * 8/1975 Uydess ..... 52/713
6,067,691 A * 5/2000 Feltman ..... 24/295

OTHER PUBLICATIONS

Photographs of prior art device on the right at top and bottom, on sale prior to applicant's invention.*

* cited by examiner

*Primary Examiner*—Carl D. Friedman
*Assistant Examiner*—Jennifer I. Thissell

(57) ABSTRACT

A clip for attachment to the flanges of a structural steel member for purposes of securing sheet material to the member is comprised of a rectangular-shaped clip of light-weight sheet material having opposite sides and opposite ends and enclosing an open center portion. A clip element is formed from a protrusion of the sheet metal material and extends outwardly from the clip and terminates in a free end which is spaced from the clip to create an open space to partially receive a flange of a steel member. The clip element is positioned with respect to the clip so that the clip dwells outwardly of the flange when mounted thereon. The clip element is comprised of a spring-like material so as to be able to frictionally engage the flange. The clip has a plurality of protruding frictional elements thereon to enhance the frictional engagement of the clip to the flange.

4 Claims, 2 Drawing Sheets

CLIP FOR ATTACHMENT TO FLANGES OF STRUCTURAL STEEL

CROSS-REFERENCE TO RELATED APPLICATIONS

This application claims the benefit of U.S. Provisional Application No. 60/149,139 filed Aug. 16, 1999.

BACKGROUND OF THE INVENTION

It is often necessary to fireproof structural steel columns, beams and the like which have a center web and extended opposite flanges. This is often accomplished by placing a plurality of clip elements in spaced condition on the flanges, and attaching wall board thereto which is thereupon treated with fireproofing material.

A problem with existing clips is that they are expensive, relatively speaking, and often slide downwardly on at least the flanges of vertical beams and do not always maintain the position needed to affix the drywall material thereto.

Therefore, it is a principal object of this invention to provide a clip element for such structural components which will rigidly secure themselves thereto, and which are economical of manufacture. These and other objects will be apparent to those skilled in the art.

SUMMARY OF THE INVENTION

Figure 1:
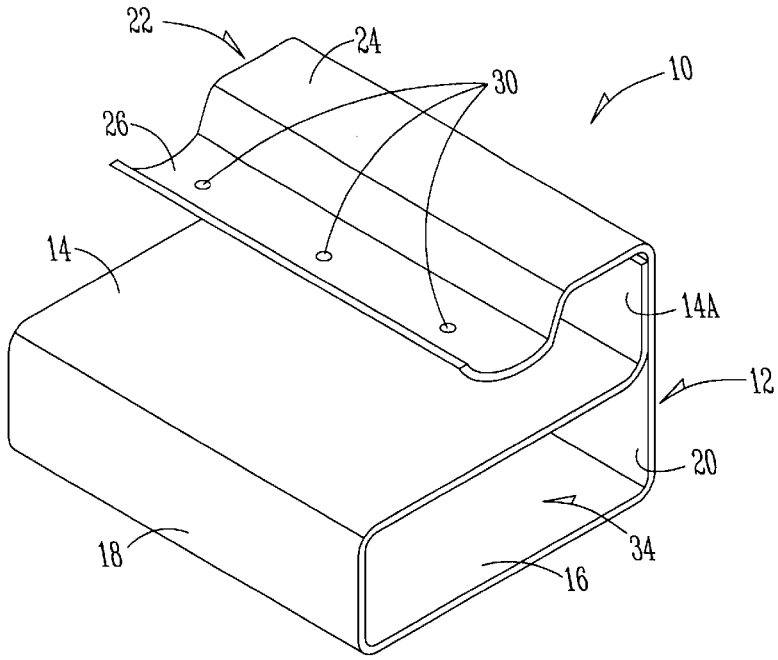
FIG. 1 is a frontal perspective view of the clip element of this invention.

A clip for attachment to the flanges of a structural steel member for purposes of securing sheet material to the member is comprised of a rectangular-shaped clip of lightweight sheet material having opposite sides and opposite ends and enclosing an open center portion. A clip element is formed from a protrusion of the sheet metal material and extends outwardly from the clip and terminates in a free end which is spaced from the clip to create an open space to partially receive a flange of a steel member. The clip element is positioned with respect to the clip so that the clip dwells outwardly of the flange when mounted thereon. The clip element is comprised of a spring-like material so as to be able to frictionally engage the flange. The clip has a plurality of protruding frictional elements thereon to enhance the frictional engagement of the clip to the flange.

DESCRIPTION OF THE PREFERRED EMBODIMENT

The clip 10 is comprised of a rectangular sheet 12 of lightweight metal similar to that of the density of conventional metal studding. The clip has a top surface 14 which has one of its ends terminating in an upstanding flange 14A. The clip has a bottom 16 that is parallel to the top surface 14, and has a front side 18 and an opposite rear side 20. The side 20 has a greater depth than side 18 and extends upwardly above top surface 14.

A clip element 22 is formed on the upper edge of the side 20 and has a horizontal portion 24 which is parallel to the upper surface 14. The horizontal portion terminates in a downwardly extending concave portion 26 which terminates in a straight lip edge 28. A plurality of apertures 30 are formed in the concave portion 26 and have downwardly extending burrs 32, (FIG. 4) extending from the apertures. A rectangular opening 34 is provided in clip 10 by the upper surface 14, the bottom surface 16, and the opposite sides 18 and 20. A clip opening 36 is formed between the clip element 22 and the upper surface 14.

Figure 3:
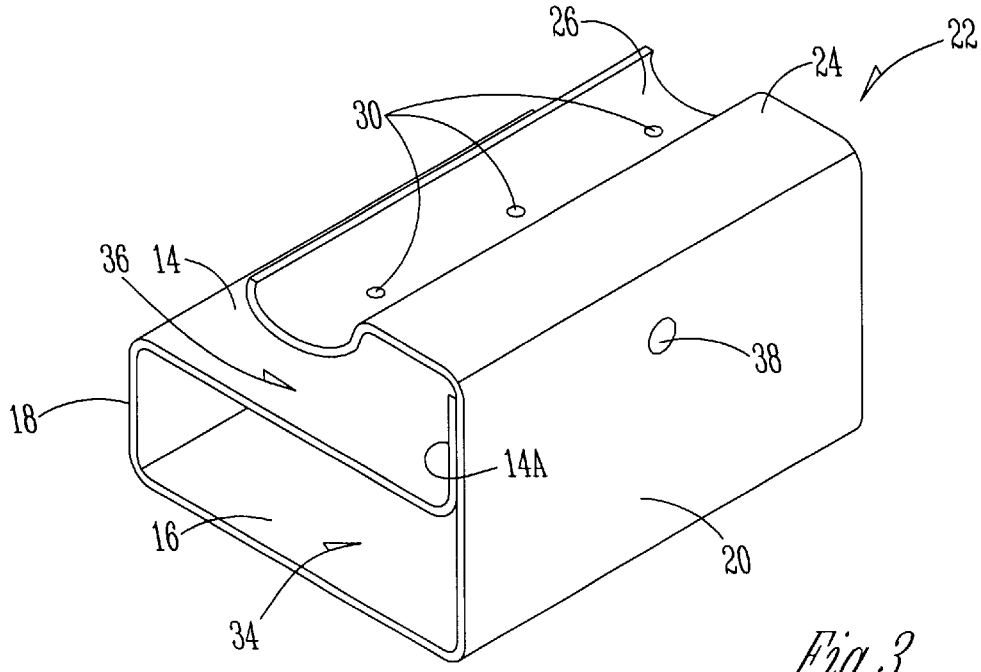
FIG. 3 is a rearward perspective view of the clip element.
Figure 4:
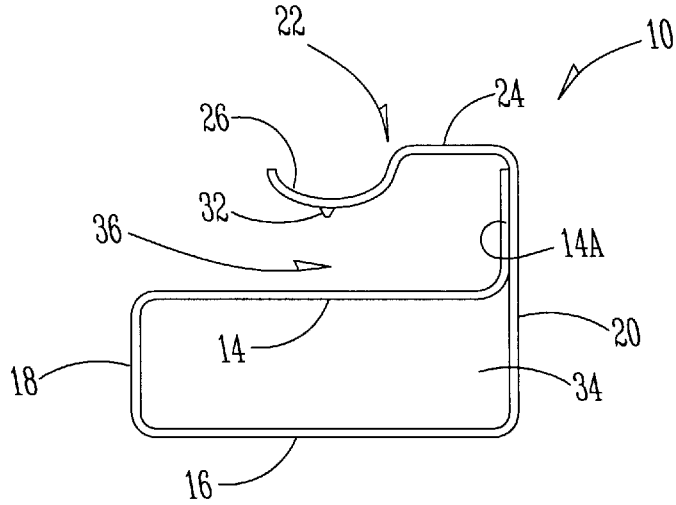
FIG. 4 is an end view seen from the lefthand end of FIG. 3.

A spot weldment 38 (FIG. 3) rigidly secures side 20 to the upstanding flange 14A. As seen in FIGS. 1, 3 and 4, the upstanding flange 14A engages the end 20 and both dwell in the same vertical plane.

FIG. 4 is a horizontal section through a column 40 comprised of a structural steel. The column 40 is of conventional construction and consists of center web 42 with opposite flanges 44.

Figure 2:
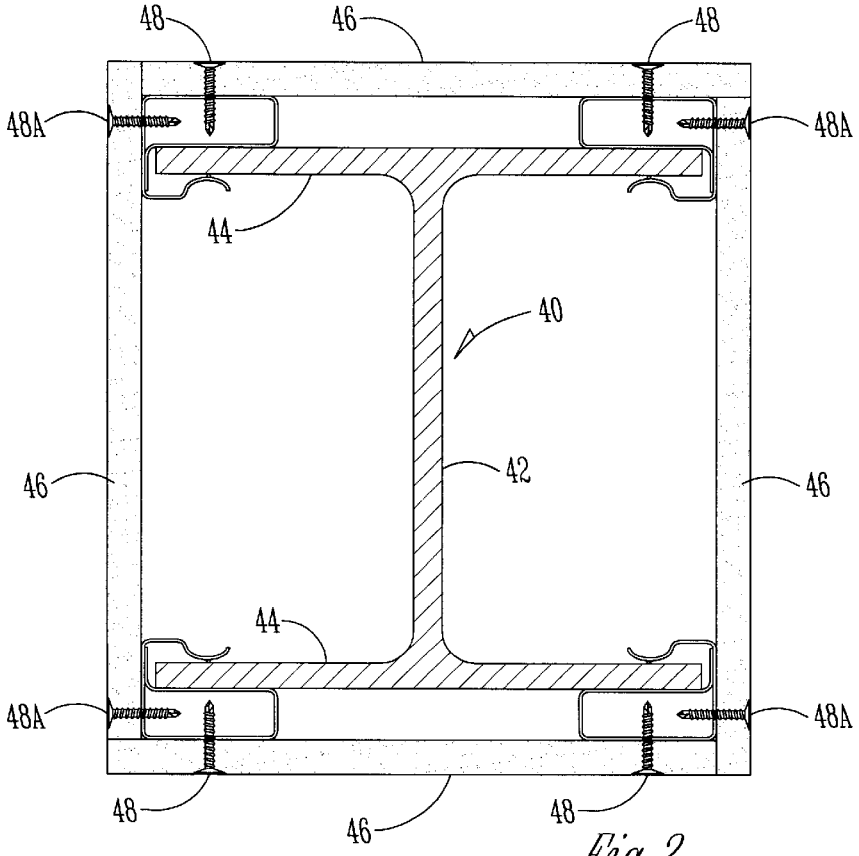
FIG. 2 is a sectional view through a column showing the clip elements attached thereto with the drywall members attached thereto.

Fireproof sheets 46 of conventional material surround the column 40 and are secured to clips 10. The clips 10 are mounted in vertically spaced condition on the flanges 44 of column 42 and the spaces between vertical clips can vary in accordance with the specifications of the fireproof sheets 46. Normally, this would be in the order of 12 inches or so. The clips 10 are mounted on the flanges 40 by inserting the open end of the flange into the clip opening 36 as best shown in FIG. 2. The burr elements 32 are forced into frictional engagement with the inter side of the flanges 44 by reason of the spring like material of the clip elements 26. The space 36 is typically less than the thickness of the flanges 44 to enhance the gripping phenomenon of the clip element 22 to the flanges.

Sheet metal screws 48 are driven through the various surfaces of clip 10 after penetrating the thickness of the sheets 46. Typically, screws 48 will penetrate the sheet 46 and thence the bottom surface 16 to terminate within space 34. Screws 48A will first penetrate the material 46 and then wall 20 to also terminate within the space 34.

Manufacturing clip 10 out of a single sheet of lightweight metal material, and configured as described, is easily held together by the single weldment 38. The clips 10 are easily installed on the flanges 44 of column 40. The fire resistant sheets 46 are secured to the clips much like wallboard is secured to vertical studding in a structural building.

It is seen that the manufacturer of the clip 10 is simplified and inexpensive; the mounting of the clips on the flange is easily and quickly accomplished; and the fire resistant sheeting material 46 is easily then secured to the clip elements.

It is therefore seen that this invention will achieve at least all of its stated objectives.

I claim:

1. A clip for attachment to the flanges of a structural steel member for purposes of securing sheet material to the member, comprising:

a rectangular-shaped clip of lightweight sheet metal material having a first end comprising an elongated flat first portion with free edge, and an opposite edge bent vertically upwardly to form a first planar flat side portion, with an upper edge bent laterally at a right angle to form a second flat planar portion and thence bent downwardly to form a second planar flat side portion parallel to and spaced from a first side portion, with a lower edge thence bent laterally and extending under to create a third flat planar portion in planar engagement with the first portion, and then extending in an upward direction and terminating in a resilient clip element, the clip element secured to the clip, wherein the clip and clip element are comprised of a single strip of sheet metal material, and extending outwardly from the clip and ending in a free end and being spaced from the clip to create an open space to partially receive a flange of the steel member.

2. The device of claim 1 wherein the first portion is spot welded to the third flat planar portion.

3. The device of claim 1 wherein a plurality of burred apertures are in the clip element.

4. A clip for attachment to the flange of a structural member, comprising, a single sheet of lightweight metal bent into a configuration having a horizontal top surface spaced from and parallel to a bottom surface, and side members connecting the top and bottom surfaces, a first opening enclosed by the top and bottom surfaces and the sides, one of the sides extending above the top surface to form a side extension, a flange extending upwardly from an edge of the top surface and dwelling against the side extension and being spot welded thereto, and a clip element formed on a top edge of the side extension and extending over in spaced relation to the upper surface to frictionally receive the flange of a structural member.

* * * * *